US008607673B2

(12) United States Patent
Marson

(10) Patent No.: US 8,607,673 B2
(45) Date of Patent: Dec. 17, 2013

(54) TOOL MODIFICATION TO PREVENT INADVERTENT RELEASE OF TOOL ATTACHMENTS

(75) Inventor: James B. Marson, Elmwood, WI (US)

(73) Assignee: James B. Marson, Elmood, WI (US)

( * ) Notice: Subject to any disclaimer, the term of this patent is extended or adjusted under 35 U.S.C. 154(b) by 240 days.

(21) Appl. No.: 13/026,420

(22) Filed: Feb. 14, 2011

(65) Prior Publication Data

US 2012/0204685 A1 Aug. 16, 2012

(51) Int. Cl.
*B24B 13/00* (2006.01)

(52) U.S. Cl.
USPC ..... 81/184; 81/177.2; 81/177.4; 81/177.85

(58) Field of Classification Search
USPC ..... 81/177.2, 177.4, 177.85, 184
See application file for complete search history.

(56) References Cited

U.S. PATENT DOCUMENTS

| | | | | |
|---|---|---|---|---|
| 3,023,015 | A | | 2/1962 | Pankow |
| 4,573,839 | A | | 3/1986 | Finnegan |
| 4,588,335 | A | | 5/1986 | Pearson, Jr. |
| 4,605,348 | A | | 8/1986 | DeCaro |
| 4,900,202 | A | | 2/1990 | Wienhold |
| 4,938,107 | A | * | 7/1990 | Nickipuck ..... 81/177.85 |
| 5,257,557 | A | | 11/1993 | Battten |
| 5,417,527 | A | | 5/1995 | Wienhold |
| 5,470,180 | A | | 11/1995 | Jore |
| 5,586,847 | A | | 12/1996 | Mattern, Jr. et al. |
| 5,678,961 | A | | 10/1997 | Fleege et al. |
| 5,682,800 | A | | 11/1997 | Jore |
| 5,779,404 | A | | 7/1998 | Jore |
| 5,954,463 | A | | 9/1999 | Jore |
| 5,975,815 | A | | 11/1999 | Zierpka et al. |
| 6,074,140 | A | | 6/2000 | Cook |
| 6,176,654 | B1 | | 1/2001 | Jore |
| D449,504 | S | | 10/2001 | Boyle et al. |
| 6,347,914 | B1 | | 2/2002 | Boyle et al. |
| 6,354,177 | B2 | | 3/2002 | Peters |
| D457,046 | S | | 5/2002 | Boyle et al. |
| 6,394,715 | B1 | | 5/2002 | Boyle et al. |
| 6,457,916 | B2 | | 10/2002 | Wienhold |
| 6,488,452 | B1 | | 12/2002 | Hoskins et al. |
| 6,722,667 | B2 | | 4/2004 | Cantlon |
| 6,761,361 | B2 | | 7/2004 | Taylor et al. |
| 6,935,637 | B2 | | 8/2005 | Cantlon |
| 7,086,813 | B1 | | 8/2006 | Boyle et al. |
| 7,334,970 | B2 | | 2/2008 | Kozak |

(Continued)

FOREIGN PATENT DOCUMENTS

| | | |
|---|---|---|
| WO | WO0164400 | 9/2001 |

OTHER PUBLICATIONS

Ace Tool Website "Makita Quad Driver"; pp. 1-2.
Irwin Tools Website "Quick Change Bit Set"; p. 1.

(Continued)

*Primary Examiner* — Lee D Wilson
*Assistant Examiner* — Shantese McDonald
(74) *Attorney, Agent, or Firm* — Thomas J. Oppold; Larkin Hoffman Daly & Lindgren, Ltd.

(57) ABSTRACT

A tool having a collar disposed rearward of a movable sleeve or tool attachment so as to deflect objects away from the rearward edge of the sleeve or tool attachment when in the tool attachment lock position thereby preventing inadvertent release of the tool attachment during use.

22 Claims, 4 Drawing Sheets

(56) References Cited

U.S. PATENT DOCUMENTS

| | | | | |
|---|---|---|---|---|
| 7,354,230 | B2 | 4/2008 | Bauman | |
| 7,374,377 | B2 | 5/2008 | Bauman | |
| 8,172,236 | B2 * | 5/2012 | Shibata | 279/143 |
| 2004/0262856 | A1 * | 12/2004 | Cantlon | 279/22 |
| 2006/0254394 | A1 | 11/2006 | Cantlon et al. | |
| 2008/0246233 | A1 | 10/2008 | Wienhold | |
| 2010/0219594 | A1 | 9/2010 | Nash | |

OTHER PUBLICATIONS

Irwin Tools Website "Lock-n-Load Quick Change Extensions"; p. 1.

Quality Distributing LLC Website "Irwin Lock-n-Load Quick Change Bit Holder Extensions"; p. 1.

Woodbin Woodworking Website "Quick Change Flip Drill Driver Bits"; pp. 1-2.

Jore Corporation Website "Quick Change"; p. 1.

"Ryobi Speed Load Plus. The Fastest and most convenient way to change bits"; pp. 1-2.

GoSale.com Website "Stanley—Fast Change Drive and Drive System"; pp. 1-2.

Amazon.com Website "Hitachi 728119 Quick Change 20-Piece Drilling and Driving Set".

Amazon.com Website "Dewalt DW2050 Quick Change 3-Inch Magnetic Bit Tip Holder".

* cited by examiner

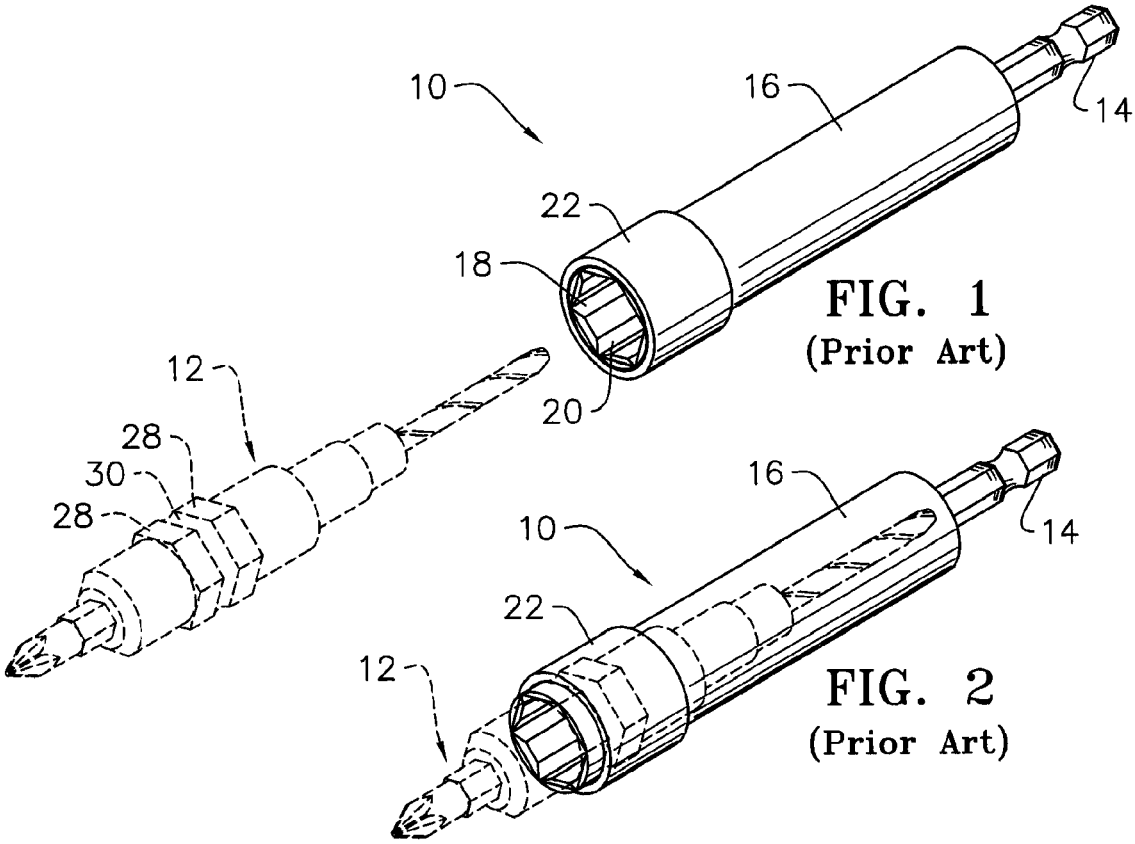
FIG. 1
(Prior Art)
FIG. 2
(Prior Art)
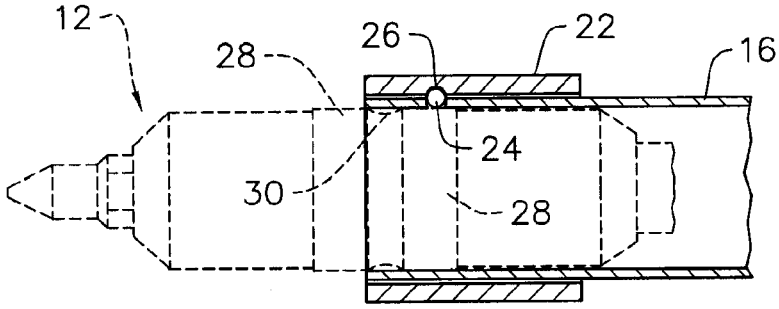
FIG. 3
(Prior Art)
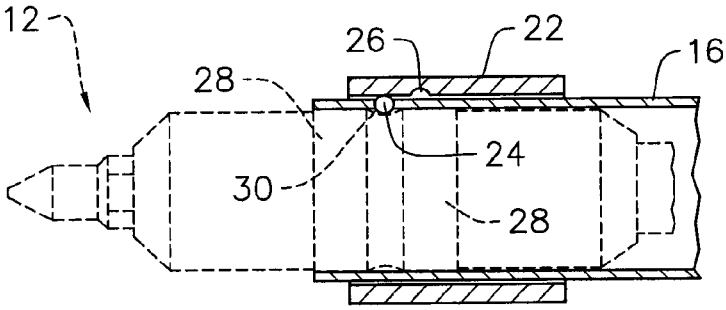
FIG. 4
(Prior Art)

TOOL MODIFICATION TO PREVENT INADVERTENT RELEASE OF TOOL ATTACHMENTS

BACKGROUND

Quick change tool bit holders, ratchet extensions and other tools adapted for holding or attaching interchangeable sockets, drivers, tool bits, etc. are well known in the art. While these various tools may serve their intended purpose, the sockets, drivers, tool bits or other attachments can be inadvertently released. Accordingly, there is a need for a relatively simple and inexpensive after market fix to prevent the inadvertent release of such tool attachments. There is also a need for a simple inexpensive solution that can be incorporated by an original equipment manufacturer to modify their existing tools to prevent the inadvertently release of such attachments.

DESCRIPTION OF THE DRAWING FIGURES

FIG. 1 is a perspective view of one embodiment of quick change tool holder adapted for use with a reversible drill bit/driver.

FIG. 2 is a perspective view of the quick change tool holder of FIG. 1 shown in the tool attachment lock position.

FIG. 3 is an enlarged partial cross-sectional view of the quick change tool holder of FIG. 1 shown in the tool attachment release position.

FIG. 4 is an enlarged partial cross-sectional view of the quick change tool holder of FIG. 2 shown in the tool attachment lock position.

DESCRIPTION

Figure 5:
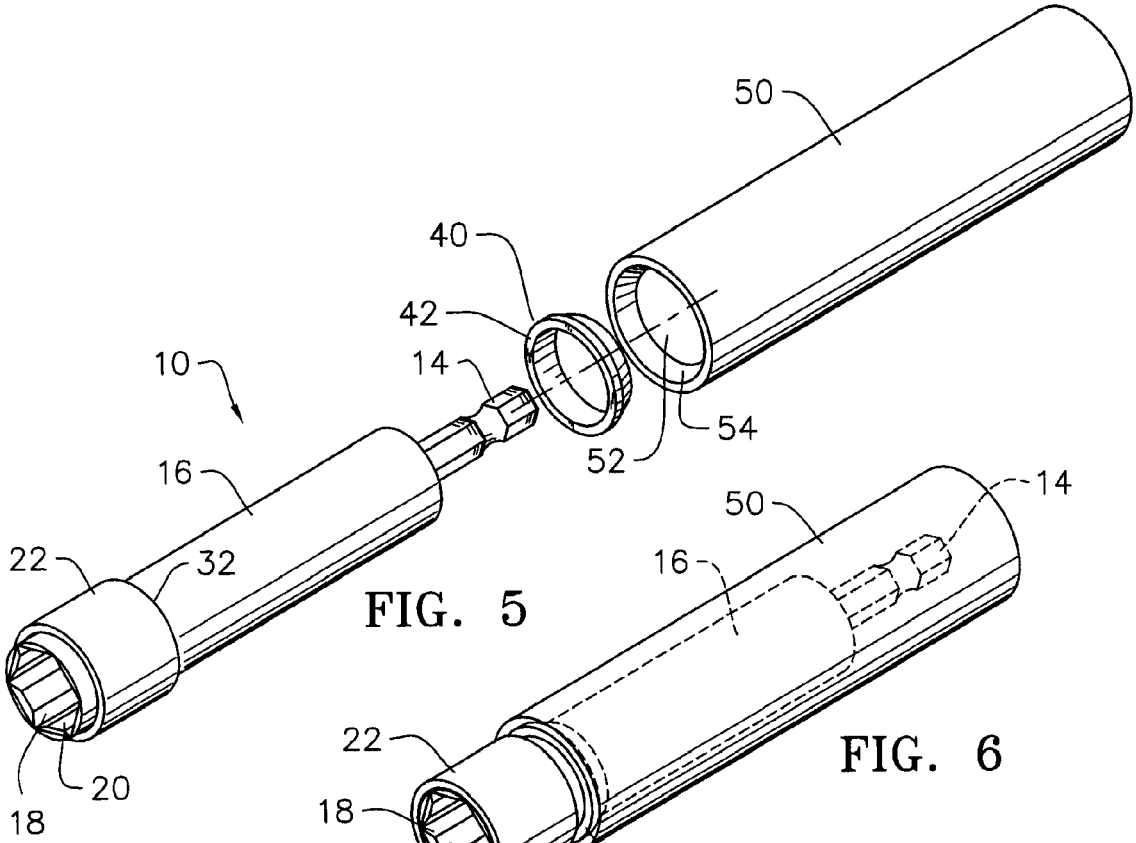
FIG. 5 is an exploded perspective view of the quick change tool holder of FIG. 1 and showing an embodiment of a collar to prevent inadvertent release of the tool attachment.
Figure 6:
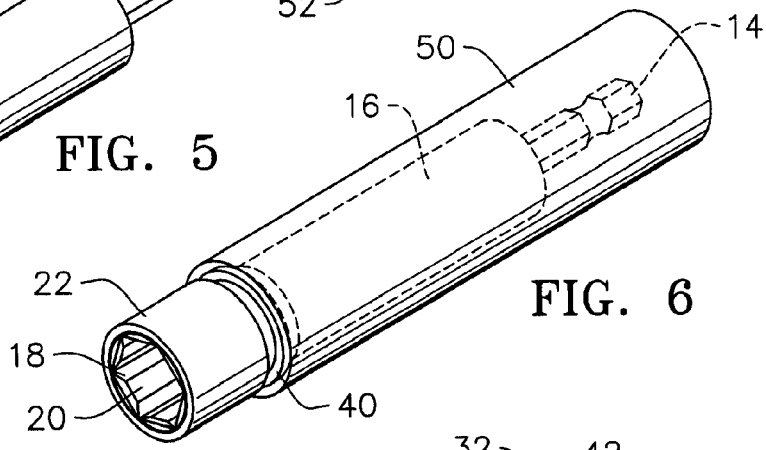
FIG. 6 is a perspective view of the quick change tool holder of FIG. 5 with the collar secured to the shaft.
Figure 7:
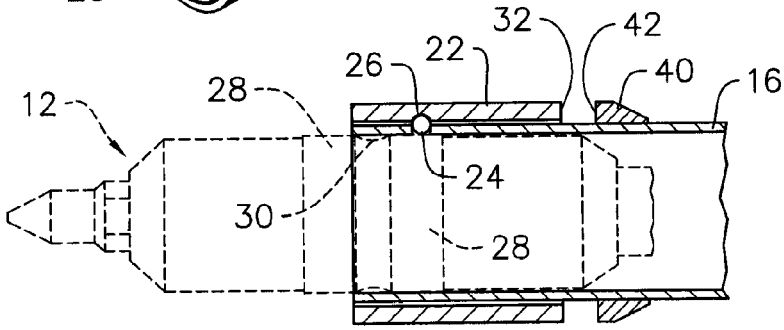
FIG. 7 is an enlarged partial cross-sectional view of the quick change tool holder with the collar secured thereto as illustrated in FIG. 6 wherein quick change tool holder is in the tool attachment release position.
Figure 8:
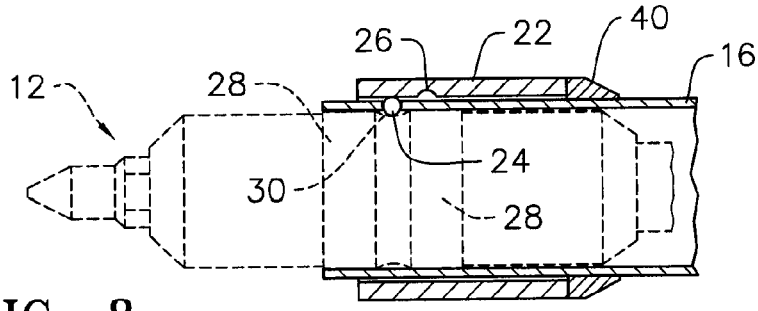
FIG. 8 is an enlarged partial cross-sectional view of the quick change tool holder with the collar secured thereto as illustrated in FIG. 7 wherein quick change tool holder is in the tool attachment lock position.
Figure 9:
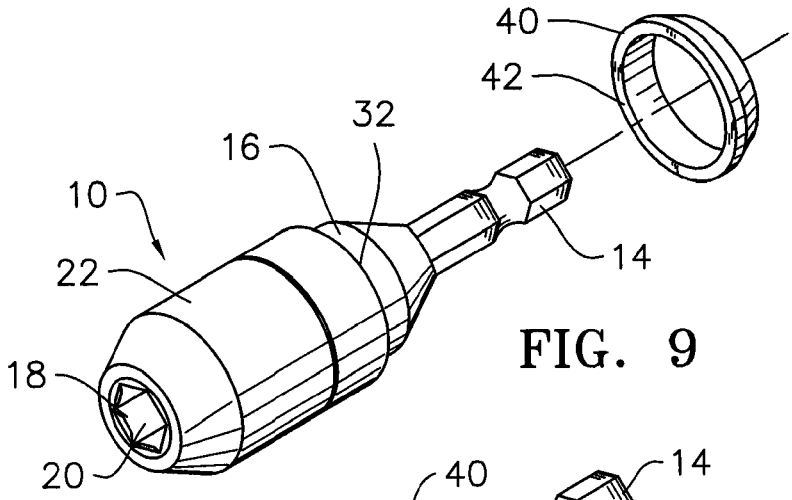
FIG. 9 is an exploded perspective view of another type of quick change tool holder and showing an embodiment of a collar to prevent inadvertent release of the tool attachment.
Figure 10:
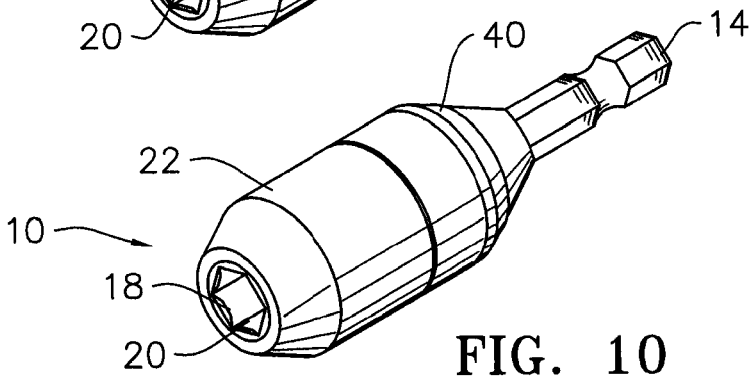
FIG. 10 is a perspective view of the quick change tool holder of FIG. 9 incorporating an embodiment of a collar to prevent inadvertent release of the tool attachment.

Referring now to the drawings, wherein like reference numerals designate identical or corresponding parts throughout the several views, FIG. 1 illustrates one embodiment of a tool 10 adapted for holding or attaching interchangeable bits, sockets and various types of drivers for Philips, hex, Torx, star, square and slot headed connectors, etc. (collectively, hereinafter, "tool attachments" 12). The tool 10 of FIG. 1 is the type of tool commonly referred to as a quick change tool holder adapted for use with the reversible drill bit/driver tool. In this embodiment, the tool 10 includes a hex shaped shank 14 that is adapted to be received by a power drill or hand held driver (not shown). The tool 10 also includes a shaft 16 having a bore 18. The bore 18 includes a socket end 20 adapted to receive and hold the tool attachment 12. Typically, the tool attachment 12 and the socket end 20 include complimentary hex shaped portions which prevent the tool attachment 12 from rotating within the socket end 20.

A sleeve 22 is movable fore and aft with respect to the shaft 16 between a tool attachment release position (FIGS. 1 and 3) and a tool attachment lock position (FIGS. 2 and 4). As best illustrated in FIG. 3, in the tool attachment release position, the sleeve 22 is moved forwardly with respect to the shaft 16. In this position, a recess 26 in the interior of the sleeve 22 aligns with the detent ball 24, thereby allowing the ball to move radially outwardly into the recess 26, so as to allow the hex shaped shoulders 28 of the tool attachment 12 to be received within the socket end 20. When fully seated into the socket, a circumferential depression 30 between the hex shaped shoulders 28 aligns with the detent ball 24. As shown in FIG. 4, as the sleeve 22 is moved rearwardly the detent ball 24 is forced downwardly into the circumferential depression 30 between the hex shaped shoulders 28, locking the tool attachment 12 within the socket end 20.

It has been found that with the type of quick change tool holders illustrated in FIGS. 1-4 wherein the sleeve 22 is pushed forwardly to release the tool attachment 12, the tool attachment 12 can sometimes be inadvertently released if the rearward edge of the sleeve 32 catches on an object, such as when the quick change tool holder 10 is attached to a drill and the drill is withdrawn from the holster of a tool belt. When the drill is being pulled from the holster, the rearward edge of the sleeve 32 often catches on the bottom of the holster forcing the sleeve 22 forwardly releasing the tool attachment 12.

To prevent objects from catching on the rearward edge 32 of the sleeve 22, a collar 40 as illustrated in FIGS. 5-8 is preferably disposed such that the forward face 42 of the collar 40 is in close proximity to the rearward edge 32 of the sleeve 22. Thus, when the sleeve 22 is in the tool attachment lock position the collar 40 will deflect objects away from the rearward edge 32 of the sleeve thereby preventing inadvertent release of the tool attachment.

The outer periphery of the collar 40 is preferably sloped, chamfered or radiused to provide a smooth transition between the shaft 16 and the sleeve 22 to better deflect objects away from the sleeve. Also, it is preferable that at least a portion of the outer periphery of the collar 40 is at least about as great as the outer periphery of the sleeve 22 so that objects cannot catch on the rearward edge 32 of the sleeve forcing it forward resulting in inadvertent release or false ejection of the tool attachment 12.

In one embodiment, the collar 40 is preferably press fit onto the shaft 16. In such an embodiment, the interior diameter of the collar 40 is preferably the same as or slightly smaller than the outside diameter of the shaft 16. To assist in press fitting the collar 40 to the shaft 16, a press tube 50 may be utilized. The press tube 50 includes an axial bore 52. The forward end of the bore 52 is preferably countersunk to provide an interior periphery 54 that is complimentary to the exterior periphery of the collar 40 such that the collar 40 will preferably seat flush with the forward end of the press tube 50. In use, the shank end of the tool 10 is inserted through the collar 40 and into the bore 52 of press tube 50. The end of the press tube 50 is then forced downwardly, preferably by a hydraulic press or by pounding, until the collar 40 is secured to the shaft 16 at the proper location. To ensure that the collar is secured at the proper location, it is preferable to move the sleeve 22 to the tool attachment lock position prior to press fitting the collar 40 in place. The collar 40 will be properly placed when the forward face 42 of the collar 40 contacts the rearward edge 32 of the sleeve 22 when the sleeve 22 is in the tool attachment lock position. To ensure that the collar 40 is not accidentally pressed too far onto the shaft 16, the depth of the bore 52 is preferably the same as the distance from the rearward most end of the shank 14 to the rearward edge of the sleeve when in the tool attachment lock position. Thus, when the bottom of the bore 52 abuts the rearward most end of the shank 14, the collar 40 is properly positioned.

It should be appreciated that instead of a press fit, the collar 40 may be bonded to the shaft 16 such as by welding or an adhesive. Alternatively, the collar 40 may be formed integral with the shaft 16 during the original manufacture of the shaft.

It should also be appreciated that although the outer periphery of the shaft 16 and collar 40 are illustrated as being cylindrical, the outer peripheries may be any suitable size and complimentary shape.

Figure 11:
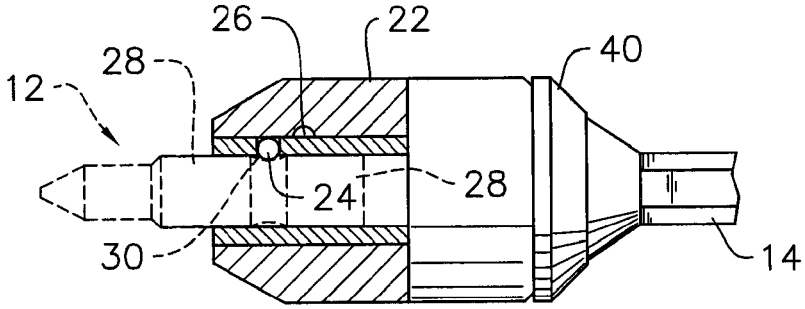
FIG. 11 is an enlarged partial cross-sectional view of the quick change tool holder with the collar as illustrated in FIG. 10 in the tool attachment release position.
Figure 12:
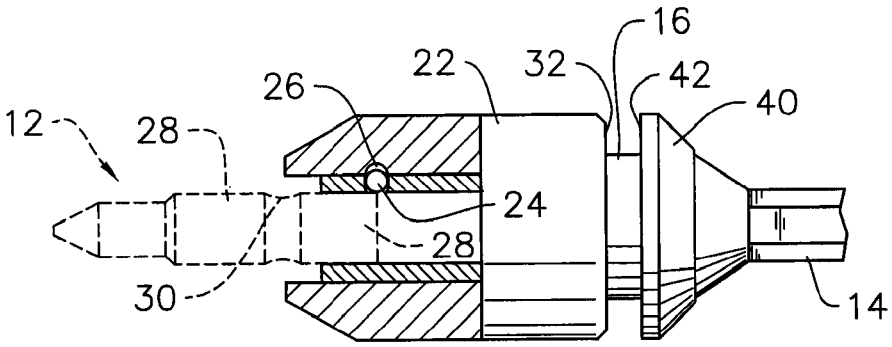
FIG. 12 is an enlarged partial cross-sectional view of the quick change tool holder with the collar as illustrated in FIG. 11 in the tool attachment lock position.

FIGS. 9-12 illustrate another embodiment of a tool 10 which is another type of quick change tool holder. In this embodiment, the sleeve 22 is spring biased (not shown) in the tool attachment lock position (FIG. 11). To move the sleeve 22 to the tool attachment release position, sufficient force must be exerted on the sleeve 22 to overcome the rearward spring bias to force the sleeve forwardly (FIG. 12). When in the tool attachment release position, a recess 26 in the interior of the sleeve 22 aligns with the detent ball 24, thereby allowing the ball to move radially outwardly into the recess 26, so as to allow the hex shaped shoulders 28 of the tool attachment 12 to be received within the socket end 20. When fully seated into the socket, a circumferential depression 30 between the hex shaped shoulders 28 aligns with the detent ball 24. As shown in FIG. 11, when the sleeve 22 is released, the spring bias forces the sleeve 22 rearwardly causing the detent ball 24 to be forced downwardly into the circumferential depression 30 between the hex shaped shoulders 28, locking the tool attachment 12 within the socket end 20.

As in the previous embodiment, a press tube 50 may be provided to assist in press fitting the collar 40 onto the shaft 16 of the tool 10 at the proper location. Also as in the previous embodiments, it should be appreciated that instead of a press fit, the collar 40 may be bonded to the shaft 16 such as by welding or an adhesive. Alternatively, the collar 40 may be formed integral with the shaft 16 during the original manufacture of the shaft. It should also be appreciated that although the outer periphery of the shaft 16 and collar 40 are illustrated as being cylindrical, the outer peripheries may be any suitable size and complimentary shape.

Figure 13:
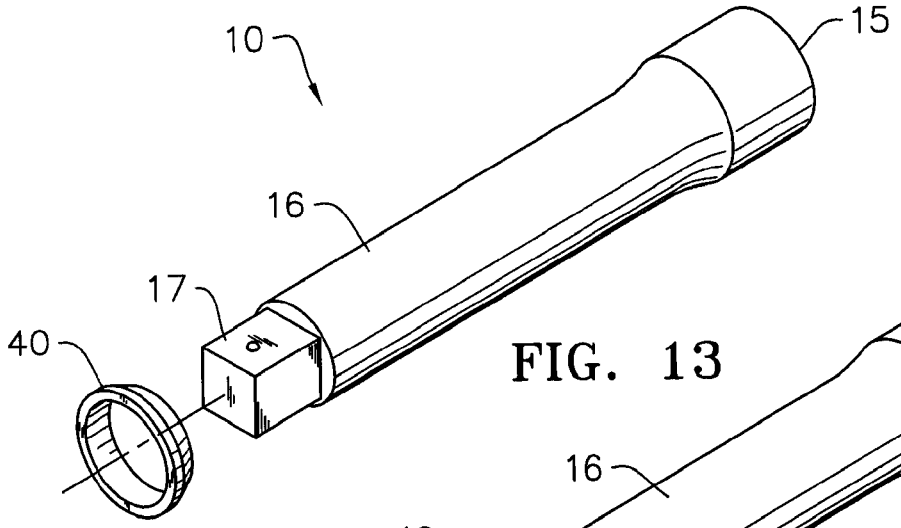
FIG. 13 is an exploded perspective view of a ratchet extension tool and showing an embodiment of a collar to prevent inadvertent release of the tool attachment.
Figure 14:
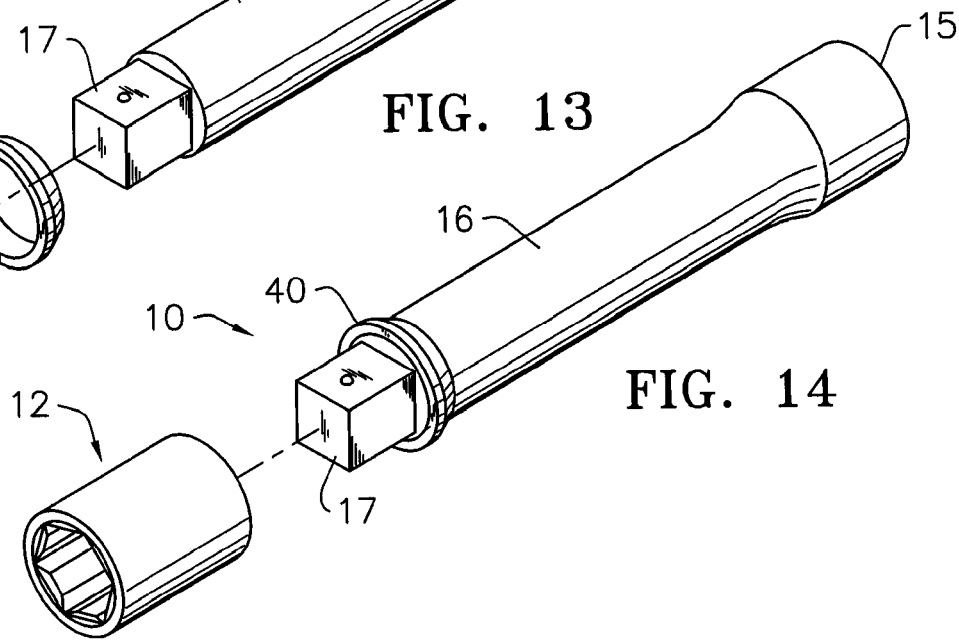
FIG. 14 is a perspective view of the ratchet extension tool of FIG. 13 incorporating an embodiment of a collar to prevent inadvertent release of the tool attachment.
Figure 15:
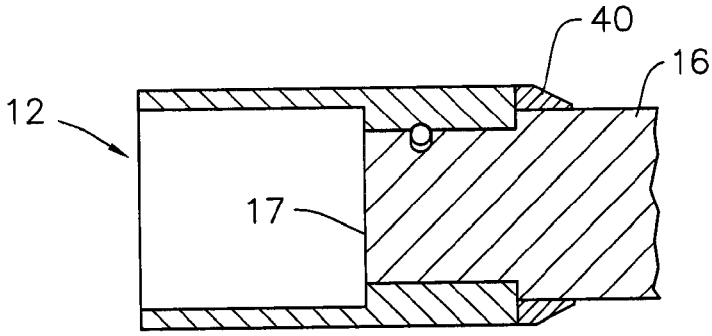
FIG. 15 is an enlarged partial cross-sectional view of the ratchet extension tool with the collar as illustrated in FIG. 14 in the tool attachment lock position.
Figure 16:
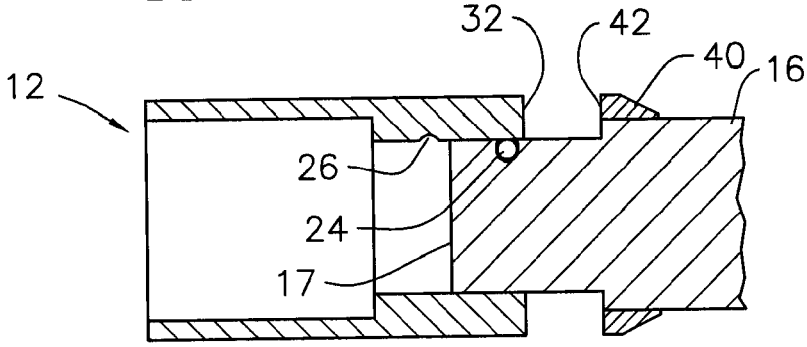
FIG. 16 is an enlarged partial cross-sectional view of the ratchet extension tool with the collar as illustrated in FIG. 14 in the tool attachment release position.

FIGS. 13-15 illustrates an embodiment of yet another tool 10 adapted for holding or attaching interchangeable tool attachments 12. In this embodiment, the tool 10 is a ratchet extension for attaching at the female end 15 to a socket wrench (not shown). Sockets, drivers or other tool attachments 12 attach to the male end 17. Unlike the previous tools discussed above, a ratchet extension does not have a movable sleeve that is used to lock and release the tool attachments 12 to the tool. Instead, the tool attachments 12 lock to the male end 17, usually by the combination of friction and a spring biased detent ball 24 projecting from the male end 17 of the tool 10 that is received within a recess 26 in the tool attachment 12. As best illustrated in FIGS. 14 and 15, as in the previous tool embodiments described above, to prevent the inadvertent release of the tool attachments 12, a collar 40 is disposed to deflect objects away from the rearward edge 32 of the tool attachment 12.

As in the previous embodiment, a press tube 50 may be provided to assist in press fitting the collar 40 onto the shaft 16 of the tool 10 at the proper location. Also as in the previous embodiments, it should be appreciated that instead of a press fit, the collar 40 may be bonded to the shaft 16 such as by welding or an adhesive. Alternatively, the collar 40 may be formed integral with the shaft 16 during the original manufacture of the shaft. It should also be appreciated that although the outer periphery of the shaft 16 and collar 40 are illustrated as being cylindrical, the outer peripheries may be any suitable size and complimentary shape.

The foregoing description is presented to enable one of ordinary skill in the art to make and use the invention and is provided in the context of a patent application and its requirements. Various modifications to the preferred embodiment of the apparatus, and the general principles and features of the system and methods described herein will be readily apparent to those of skill in the art. Thus, the present invention is not to be limited to the embodiments of the apparatus, system and methods described above and illustrated in the drawing figures, but is to be accorded the widest scope consistent with the spirit and scope of the appended claims.

The invention claimed is:

1. A tool for interchangeable tool attachments, the tool comprising:

a tool shaft having a tool attachment end for receiving the tool attachment;

a sleeve movable with respect to the tool shaft between a tool attachment lock position and a tool attachment release position, wherein in the tool attachment lock position, the sleeve is moved in a direction opposite the tool attachment end, and wherein in the tool attachment release position the sleeve is moved in a direction toward the tool attachment end, the sleeve having a rearward edge and an outer periphery greater than an outer periphery of the tool shaft;

a collar having a forward end and an outer peripheral portion at least about as great as the sleeve outer periphery, the collar disposed rearward of the movable sleeve wherein the collar forward end is in close proximity to the sleeve rearward end when in the tool attachment lock position so as to deflect objects away from the rearward edge of the sleeve when in the tool attachment lock position thereby preventing inadvertent release of the tool attachment during use.

2. The tool of claim 1 wherein the collar is press-fit to the tool shaft.

3. The tool of claim 1 wherein the collar is formed integral with the tool shaft.

4. The tool of claim 1 wherein the collar is bonded to the tool shaft.

5. The tool of claim 1 wherein the tool attachment is a reversible driver.

6. The tool of claim 1 wherein the tool attachment is a driver.

7. The tool of claim 1 wherein the tool attachment is a socket.

8. A tool for interchangeable tool attachments, the tool comprising:

a tool shaft having a tool attachment end for receiving the tool attachment, the tool attachment movable with respect to the tool shaft between a tool attachment lock position and a tool attachment release position, wherein in the tool attachment lock position, the tool attachment is moved in a direction opposite the tool attachment end, and wherein in the tool attachment release position the tool attachment is moved in a direction toward the tool attachment end, the tool attachment having a rearward edge and an outer periphery greater than an outer periphery of the tool shaft;

a collar having a forward end and an outer peripheral portion at least about as great as the tool attachment outer periphery, the collar forward end disposed in close proximity to the tool attachment rearward end when in the tool attachment lock position so as to deflect objects away from the rearward edge of the sleeve when in the tool attachment lock position thereby preventing inadvertent release of the tool attachment during use.

9. The tool of claim 8 wherein the collar is press-fit to the tool shaft.

10. The tool of claim 8 wherein the collar is formed integral with the tool shaft.

11. The tool of claim 8 wherein the collar is bonded to the tool shaft.

12. The tool of claim 8 wherein the tool attachment is a reversible driver.

13. The tool of claim 8 wherein the tool attachment is a driver.

14. The tool of claim 8 wherein the tool attachment is a socket.

15. A method of modifying a tool to prevent inadvertent release of a tool attachment, the method comprising:

a) providing a tool having a shaft with a bore at one end for receiving the tool attachment, the tool further having a sleeve movable with respect to the shaft between a tool attachment lock position and a tool attachment release position, wherein in the tool attachment lock position, the sleeve is moved in a direction opposite the bore end to lock the tool attachment within the bore end, and wherein in the tool attachment release position the sleeve is moved in a direction toward the bore end to release the tool attachment, the sleeve having a rearward edge and an outer periphery greater than an outer periphery of the shaft;

b) providing a collar having a forward end and an outer peripheral portion at least about as great as the outer periphery of the sleeve;

c) securing the collar to the shaft rearward of the movable sleeve such that the collar forward end is disposed in close proximity to the sleeve rearward edge when in the tool attachment lock position so as to deflect objects away from the rearward edge of the sleeve when in the tool attachment lock position thereby preventing inadvertent release of the tool attachment during use.

16. The method of claim 15 wherein the step of securing the collar includes press-fitting the collar to the shaft.

17. The method of claim 15 wherein the step of securing the collar includes forming the collar integral with the shaft.

18. The method of claim 15 wherein the step of securing the collar includes bonding the collar to the shaft.

19. A method of modifying a tool to prevent inadvertent release of a tool attachment, the method comprising:

(a) providing a tool having a shaft, the shaft having a tool attachment end for receiving the tool attachment, the tool attachment movable with respect to the tool shaft between a tool attachment lock position and a tool attachment release position, wherein in the tool attachment lock position, the tool attachment is moved in a direction opposite the tool attachment end, and wherein in the tool attachment release position the tool attachment is moved in a direction toward the tool attachment end, the tool attachment having a rearward edge and an outer periphery greater than an outer periphery of the tool shaft;

(b) providing a collar having a forward end and an outer peripheral portion at least about as great as the outer periphery of the tool attachment;

(c) securing the collar to the tool shaft such that the collar forward end is disposed in close proximity to the tool attachment rearward edge when in the tool attachment lock position so as to deflect objects away from the rearward edge of the tool attachment when in the tool attachment lock position thereby preventing inadvertent release of the tool attachment during use.

20. The method of claim 19 wherein the step of securing the collar includes press-fitting the collar to the shaft.

21. The method of claim 19 wherein the step of securing the collar includes forming the collar integral with the shaft.

22. The method of claim 19 wherein the step of securing the collar includes bonding the collar to the shaft.

* * * * *